US008656667B2

(12) United States Patent
Beall

(10) Patent No.: US 8,656,667 B2
(45) Date of Patent: Feb. 25, 2014

(54) ROOFING COMPOSITION

(75) Inventor: Jerry Beall, Wooster, OH (US)

(73) Assignee: Seaman Corporation, Wooster, OH (US)

( * ) Notice: Subject to any disclaimer, the term of this patent is extended or adjusted under 35 U.S.C. 154(b) by 81 days.

(21) Appl. No.: 12/953,853

(22) Filed: Nov. 24, 2010

(65) Prior Publication Data

US 2012/0126529 A1 May 24, 2012

(51) Int. Cl.

| | |
|---|---|
| ***E04H 12/28*** | (2006.01) |
| ***E04D 13/14*** | (2006.01) |
| ***E04G 15/06*** | (2006.01) |
| ***E04B 5/48*** | (2006.01) |
| ***E04D 13/00*** | (2006.01) |
| *E04D 13/04* | (2006.01) |

(52) U.S. Cl.

CPC ..... *E04D 13/1407* (2013.01); *E04D 13/0409* (2013.01)

USPC ..... 52/219; 285/42

(58) Field of Classification Search

USPC ..... 52/219, 58, 60, 63, 220.8, 98, 198, 218, 52/59, 61, 62; 285/42, 43, 44; 277/628, 277/644

See application file for complete search history.

(56) References Cited

U.S. PATENT DOCUMENTS

| | | | | |
|---|---|---|---|---|
| 5,176,408 | A * | 1/1993 | Pedersen | 285/42 |
| 6,110,311 | A * | 8/2000 | Mayle et al. | 156/189 |
| 6,513,291 | B2 * | 2/2003 | Gilsdorf | 52/297 |
| 6,691,473 | B1 * | 2/2004 | Mayle et al. | 52/198 |
| 6,892,499 | B1 * | 5/2005 | Mayle | 52/219 |
| 7,770,335 | B2 * | 8/2010 | Evensen | 52/60 |
| 8,141,303 | B2 * | 3/2012 | McDow et al. | 52/58 |
| 2010/0109318 | A1 * | 5/2010 | Mulligan | 285/42 |

* cited by examiner

*Primary Examiner* — William Gilbert
*Assistant Examiner* — Kyle Walraed-Sullivan
(74) *Attorney, Agent, or Firm* — Roetzel & Andress; Michael J. Keller

(57) ABSTRACT

A split-flashing composition for covering a protrusion from a roof, having a flange for sealing to a roof surface with an in-plane spiral closed-loop opening with first and second end portions connected together in an offset manner, and a generally conical collar portion that extends from the flange portion, the collar portion having a curved wall section and a planar wall section that define an internal volume within the collar portion.

7 Claims, 6 Drawing Sheets

ROOFING COMPOSITION

RELATED APPLICATION DATA BACKGROUND OF THE INVENTION

It is well known that protrusions extending upwardly from a sealing membrane on a roofing surface can create holes in the membrane. Non-limiting examples include pipes that extend from rooftops. Because holes are created in the sealing membranes, there is an ongoing need in the art for sealing compositions and devices that can create a watertight seal between the upward protrusion and the sealing membrane—thereby preventing fluid from leaking through the hole in the membrane and into the underlying structure.

DETAILED DESCRIPTION OF THE INVENTION

Figure 1A:
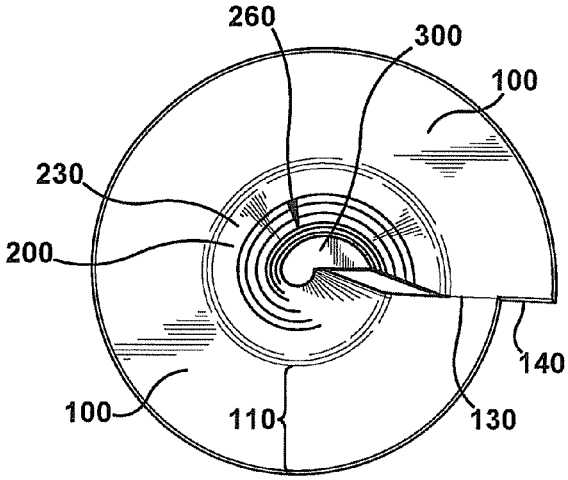
FIG. 1A is a top view of an embodiment.
Figure 1B:
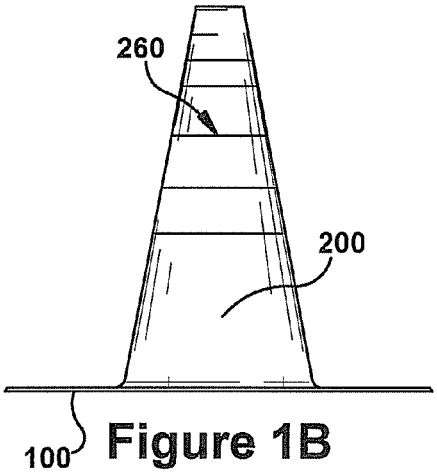
FIG. 1B is a side view of an embodiment.
Figure 1C:
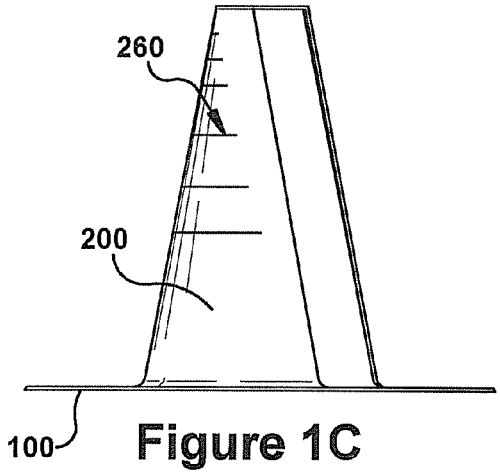
FIG. 1C is a side view of an embodiment.

Embodiments are directed to a split-flashing composition useful for covering a protrusion on a roof—such as a cylindrical or non-cylindrical pipe that protrudes from a roof. The embodiments are particularly useful for performing split-flashing techniques in order to seal or waterproof a rooftop.

With reference to the figures, embodiments of split-flashing composition 010 include one or more of the following elements: flange portion 100, collar portion 200, and collar cap portion 300.

With reference to the figures, flange portion 100 is the portion of split-flashing composition 010 that is adapted for sealing to a roof surface.

Embodiments provide for flange portion 100 being substantially flat and planar. Flange portion 100 spirals in-plane and approximately 360 degrees from first flange end portion 130 to second flange end portion 140. Embodiments provide for the flange to spiral any range of degrees, and non-limiting examples of useful degrees include: 340, 345, 350, 355, 360, 365, 370, 375, and 380. Embodiments are not limited to any particular degree of flange spiral and allow for flange portion 100 to spiral outwardly from first flange end portion 130 to second flange end portion 140.

Because of the substantially planar spiral configuration of flange portion 100, first flange end portion 130 and second flange end portion 140 may not connect to each other in an aligned fashion. Embodiments allow for first flange end portion 130 to connect to second flange end portion 140 in the off-set manner as shown in the figures or any other sort of off-set manner. Embodiments provide for the connection of first flange end portion 130 and second flange end portion 140 to describe closed-loop opening 120—that may receive a protrusion from a roof, such as a pipe protruding from a roof. As shown in the figures, closed-loop opening 120 is described by spiraling flange portion 100 that is connected in an off-set manner, and in an embodiment closed-loop opening 120 has a shape that may best be described as a spiraling tear-drop shape.

Flange portion 100 can have a substantially constant flange width 110. Other embodiments provide for inconsistent and varying flange widths that may be necessary to accommodate particular roofing applications. Useful flange widths, either constant or varying, may be determined by persons of ordinary skill in the art without having to exercise undue experimentation.

With reference to the figures, collar portion 100 is the upright portion of split-flashing composition 010 that is adapted for fixedly attaching to a protrusion—such as a pipe protruding from a roof.

Regarding collar portion 200, and as shown in the drawings, embodiments provide for collar portion 200 having a general conical shape that is made up of substantially curved wall section 230. In other embodiments, collar portion 200 has a general conical shape that is made up of both substantially curved wall section 230 and substantially planar wall section 240.

In embodiments, substantially curved wall section 230 spirals around collar portion longitudinal axis 250 approximately 360 degrees such that substantially curved wall section 230 spirals outwardly from first substantially curved wall section edge portion 234 to second substantially curved wall section edge portion 238. Substantially curved wall section 230 may also spiral around a collar portion longitudinal axis 250 an equivalent number of degrees as that of the flange portion 100. Embodiments provide for substantially curved wall section 230 spiraling outwardly any range of degrees, and non-limiting examples of useful degrees of spiral include: 340, 345, 350, 355, 360, 365, 370, 375, 380, and any range therein. Embodiments are not limited to any particular degree of spiraling for substantially curved-wall section 230, and substantially curved wall section 230 may spiral outwardly in either a clockwise or counterclockwise direction.

Embodiments provide for substantially curved wall section 230 spiraling outwardly approximately 360 degrees. With reference to the figures, in collar-portion embodiments that include substantially planar wall section 240, substantially curved wall section 230 begins and ends its spiraling at substantially planar wall section 240. Embodiments provide for substantially planar wall section 240 to be substantially perpendicular to both the first and second substantially curved wall section edge portions 234, 238. Relative to first substantially curved wall section edge portion 234, embodiments provide for substantially planar wall section 240 being both perpendicular and positioned in an outwardly direction from collar portion longitudinal axis 250. And relative to second substantially curved wall section end portion 238, embodiments provide for substantially planar wall section 240 being both perpendicular and positioned in an inwardly direction towards collar portion longitudinal axis 250.

Collar portion 200 has a general conical or cone-like shape because collar portion 200 narrows as the height of collar portion 200 increases. More specifically, and referring to collar-portion configurations having substantially planar wall section 240, the cross-sectional area of the internal volume of space described by substantially curved wall section 230 and substantially planar wall section 240, the subject cross-sectional area being in a plane perpendicular to collar portion longitudinal axis 250, decreases as the distance between the cross-sectional area and flange portion 100 increases.

In other embodiments, collar portion 200 does not have a conical shape, but instead has a substantially constant cylindrical shape such that substantially curved wall section 230 remains perpendicular and vertical relative to flange portion 100 the entire longitudinal height of curved wall section 230. As a result, the cross-sectional area of the internal volume of space described by substantially curved wall section 230 and substantially planar wall section 240, the subject cross-sectional area being in a plane perpendicular to collar portion longitudinal axis 250, remains substantially constant as the distance between the cross-sectional area of collar portion 200 and flange portion 100 increases.

Embodiments provide for substantially planar wall section 240 to be substantially perpendicular to both flange portion 100 and substantially curved wall section 230. Embodiments also provide for substantially planar wall section 240 to be substantially rectangular, wherein the height of substantially planar wall section 240 is approximately equal to the height of substantially curved wall section 230.

Figure 2A:
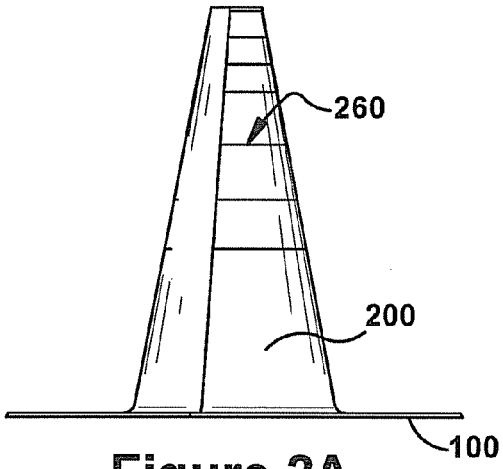
FIG. 2A is a side view of an embodiment.
Figure 2B:
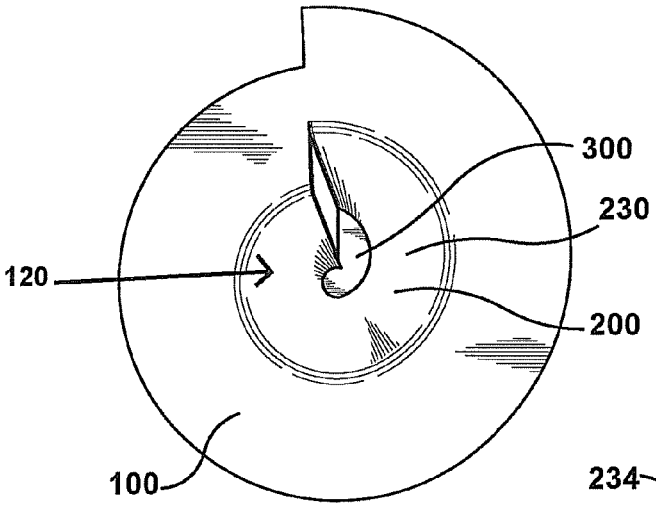
FIG. 2B is a bottom view of an embodiment.
Figure 2C:
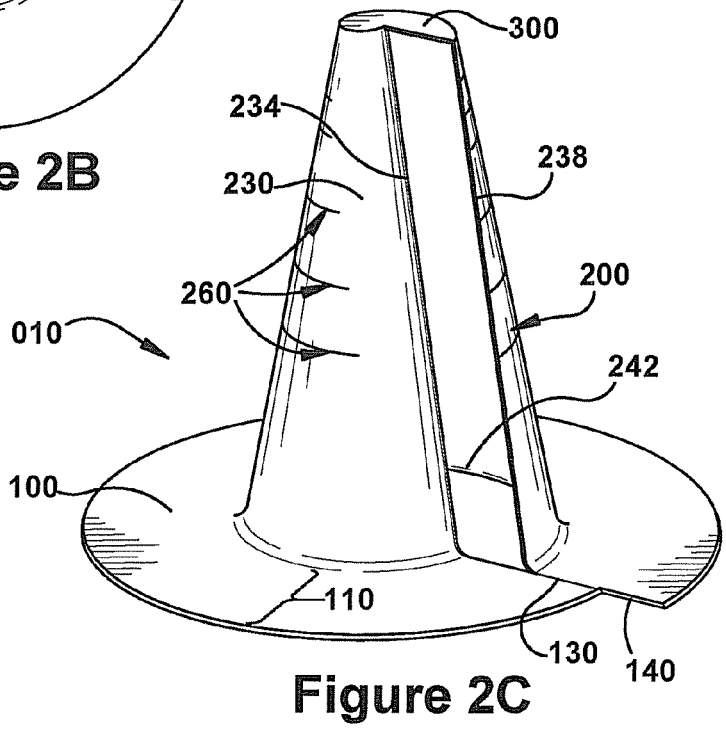
FIG. 2C is a side perspective view of an embodiment.
Figure 3A:
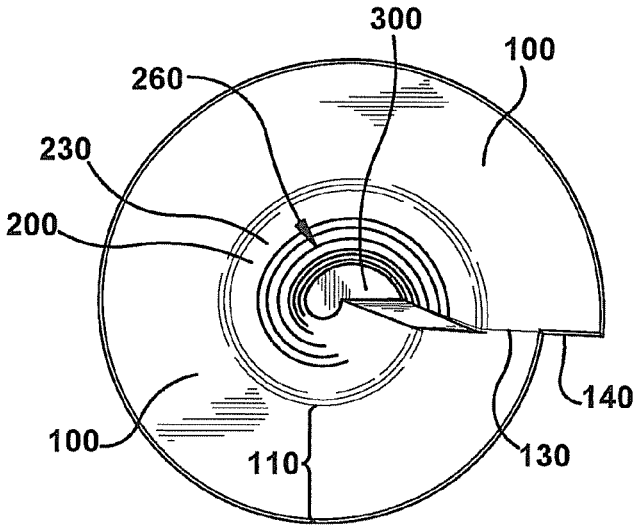
FIG. 3A is a top view of an embodiment.
Figure 3B:
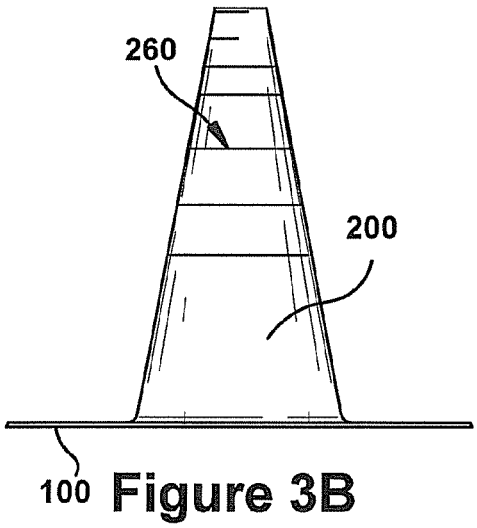
FIG. 3B is a side view of an embodiment
Figure 3C:
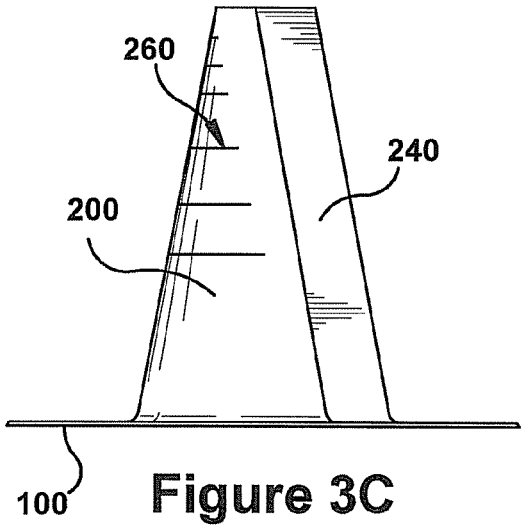
FIG. 3C is a side view of an embodiment.
Figure 4A:
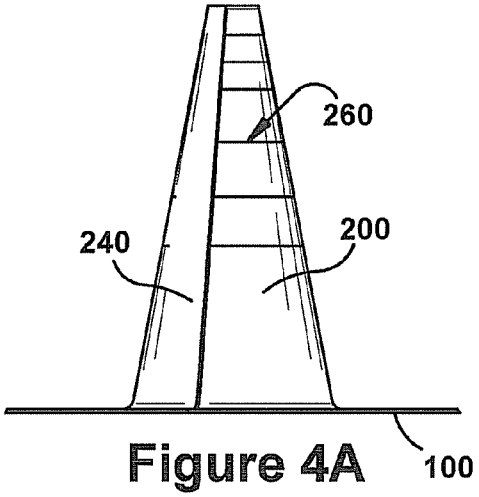
FIG. 4A is a side view of an embodiment.
Figure 4B:
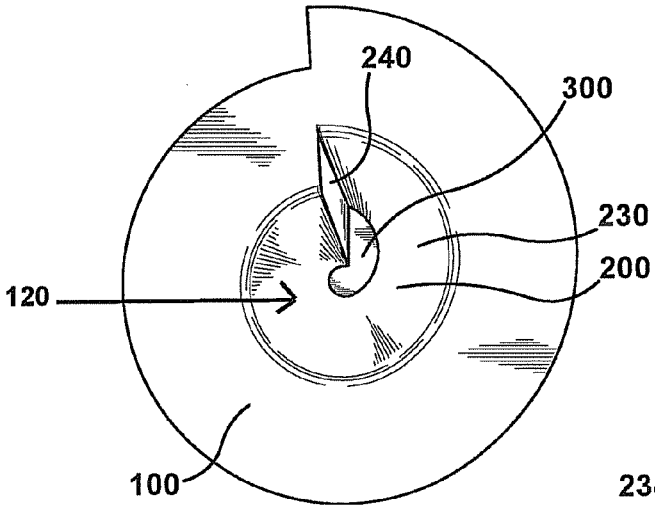
FIG. 4B is a bottom view of an embodiment.
Figure 4C:
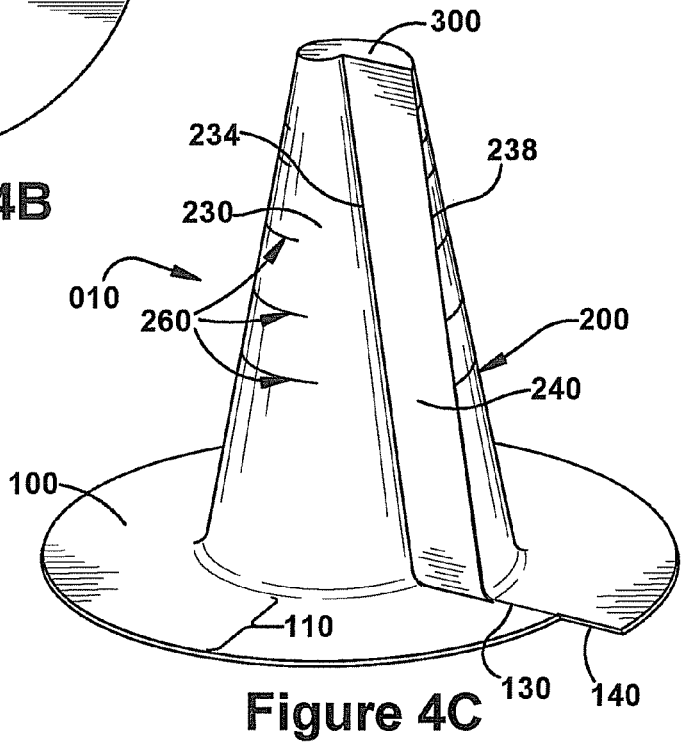
FIG. 4C is a side perspective view of an embodiment.
Figure 5A:
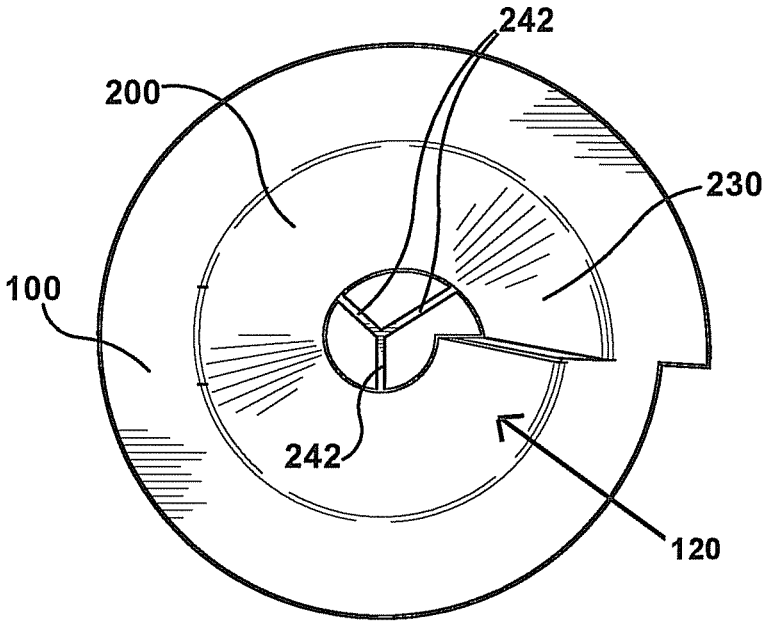
FIG. 5A is a bottom view of an embodiment.
Figure 5B:
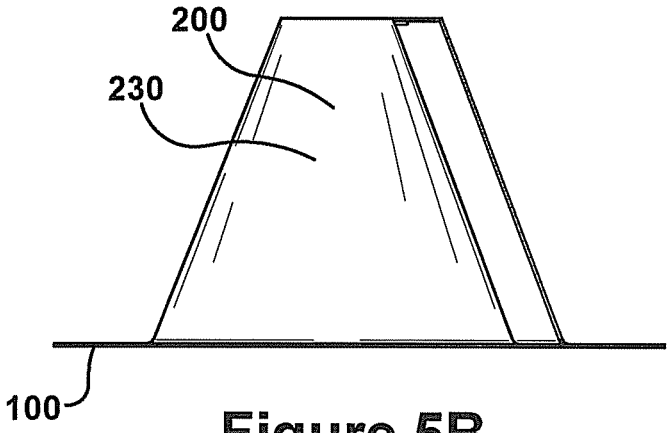
FIG. 5B is a side view of an embodiment.
Figure 6A:
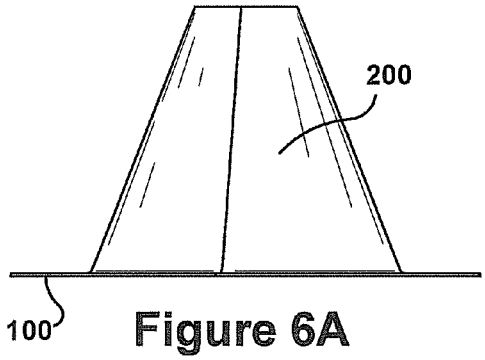
FIG. 6A is a side view of an embodiment.
Figure 6B:
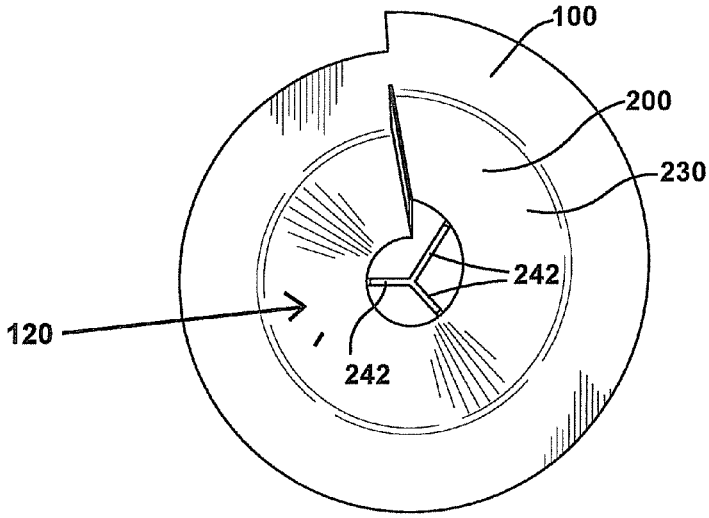
FIG. 6B is a bottom view of an embodiment.
Figure 6C:
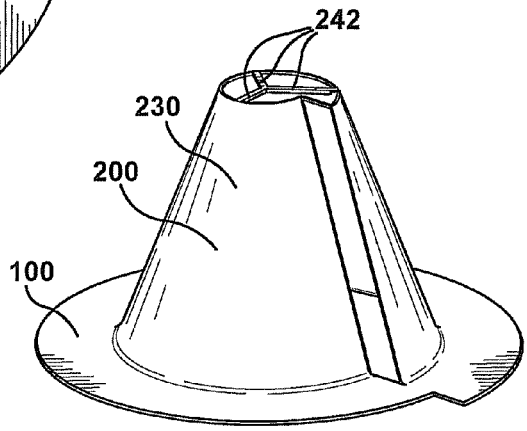
FIG. 6C is a side perspective view of an embodiment.

Regarding substantially planar wall section 240, and with reference to the figures, some embodiments provide for substantially planar wall section 240 to have different useful configurations and constructions. As non-limiting examples, and referring to FIGS. 4A-4C, substantially planar wall section 240 can have a solid sheet-like configuration. In other embodiments, and as shown in FIG. 2C, substantially planar wall section 240 is not a solid planar sheet, but instead is made up of at least one removable spoke-like or rod-like members 242 that connect first substantially curved wall section edge portion 234 and second substantially curved wall section edge portion 238. In still other embodiments, and as mentioned above, substantially planar wall section 240 is simply absent from collar portion 200, such that first substantially curved wall section edge portion 234 and second substantially curved wall section edge portion 238 are disconnected due to the absence of substantially planar wall section 240.

In embodiments, the end-user can increase the working diameter of conical collar portion 200 by cutting and removing sections of collar portion 200. The working diameter of conical collar portion 200 is defined as the range of pipe diameters that the top or uppermost portion of collar portion 200 can completely accommodate or wrap around. Because embodiments provide for the conical shape of collar portion 200, removal of top or upper sections of collar portion 200 necessarily increases the working diameter of conical collar portion 200. Top or upper sections of collar portion 200 may be cut off and removed by an end-user in order to adjust the collar portion working diameter to accommodate or match the target pipe diameter. To assist an end user in cutting away an appropriate amount of collar portion 200, embodiments provide at least one or a plurality of ring-like visual markings 260 on the exterior surface of substantially curved wall section 230, wherein the ring-like visual markings 260 provide the end user with a visual indication of where to cut collar portion 200 and the resulting working diameter after cutting and removing the respective portions of conical collar portion 200. Persons of ordinary skill in the art can determine where to place the ring-like visual markings 260 on the exterior surface of curved wall section 230 without having to exercise undue experimentation.

In some embodiments split-flashing composition 010 includes flange portion 100 collar portion 200 and collar cap portion 300. As shown in figures, the collar cap portion 300 is an element located at the uppermost/top portion of collar portion 200. Collar cap portion 300 assists collar portion in maintaining its conical shape during manufacturing and storage. Embodiments provide for removing collar cap portion 300 to enable use of split-flashing composition 010. Embodiments provide for collar cap portion 300 being in a plane that is substantially parallel to the plane in which flange portion 100 rests. In some embodiments collar cap portion 300 has a flat planar construction and in other embodiments, collar cap portion has a construction made up of spoke-like or rod-like members 242.

As shown in the figures, embodiments provide for split-flashing composition 010 having a one-piece construction wherein the same material has been used to construct all elements of split-flashing composition 010—including flange portion 100, collar portion 200, and collar cap portion 300. Embodiments provide for a one-piece construction being seamless and having no welds that connect any of the elements to another element. Other embodiments provide for split-flashing composition 010 having a multi-piece welded construction wherein the same material is used to construct all elements of split-flashing composition 010 but at least one weld is used to connect any of the splint-flashing elements to another element. Still further, embodiments provide for split-flashing composition 010 having a multi-piece welded construction wherein more than one manufacturing material is used to construct the elements of split-flashing composition 010 and welding or attachment techniques know in the art are used to connect the elements to one another.

Materials useful for manufacturing split-flashing composition 010 include any material known to be useful in the roofing industry for manufacturing split flashing or stack-boot compositions. Non-limiting examples of materials that can be used include: polyvinyl chloride PVC, nitrile butadiene polymer NBP, chlorinated polyethylene CPE, chlorosulfonated polyethylene CSPE, copolymer alloy CPA, ketone ethylene esther KEE, ethylene copolymer, thermoplastic polyolefin (TPO), rubber, ethylene propylene diene monomer EPDM, polyisobutylene PIB, and combinations thereof. Manufacturing materials may be used alone or in combination, and there is no limitation on the materials or combination of materials that can be used to manufacture split-flashing composition 010.

Conventional molding and welding methods can be used by persons of ordinary skill in the art to manufacture split-flashing composition 010. As a non-limiting example, split-flashing composition 010 can be manufactured from a single material using an injection molding process, vacuum forming process, or other conventional molding process by a person of ordinary skill in the art without having to exercise undue experimentation. Molding temperatures, pressures, and settings can readily be determined by persons of ordinary skill in the art based upon the materials being molded.

In those embodiments having a multi-piece welded construction, conventional methods can be used to fixedly attach or weld a first element to a second element.

Very generally, and with respect to those embodiments having substantially planar wall section 240 and collar cap portion 300; split-flashing composition 010 can be used by cutting off or otherwise removing collar cap portion 300, cutting off or otherwise removing substantially planar wall section 240, cutting and thereby disconnecting first flange end portion 130 from second flange end portion 140, and then wrapping and fixedly attaching the resulting one-piece disconnected split-flashing composition both to and around a protrusion.

In those split-flashing composition embodiments that do not include substantially planer wall section 240 and collar cap portion 300, only cutting and thereby disconnecting first flange portion 130 from second flange end portion 140 needs to be performed prior to wrapping and fixedly attaching the resulting one-piece disconnected split-flashing composition both to and around a protrusion.

With reference to the figures, split-flashing composition 010 can be used to cover a protrusion from a roof, such as a pipe that protrudes from a roof. Depending on the protrusion or pipe configuration, split-flashing composition 010 can be placed around the protrusion or pipe either before or after a split-flashing one-piece disconnected structure has been created. In order to use split-flashing composition 010, embodiments provide for first creating a split-flashing one-piece disconnected structure from split-flashing composition 010. A split-flashing one-piece disconnected structure can be created by removing substantially planer wall section 240, removing collar cap portion 300, and disconnecting first flange end portion 130 from second flange end portion 140, thereby altering split-flashing composition 010 from a one-piece connected structure to a one-piece disconnected structure. First substantially curved wall section edge portion 234 may then be applied to the protrusion, e.g. a pipe, and then the split-flashing disconnected structure is wrapped around the protrusion in such a way that the second substantially curved wall section edge portion 238 connects with or overlaps the first substantially curved wall section edge portion 234. Second substantially curved wall section edge portion 238 is then fixedly attached, e.g., via welding, adhesive, or another method well known in the art, to substantially curved wall section 230 such that the subject protrusion is covered.

Collar portion 200 can be fixedly attached to the subject protrusion using some type of clamping arrangement known in the roofing art, and a non-limiting example of a clamping arrangement may include a worm gear hose clamp and sealant—both of which are well known in the roofing industry. Non-limiting examples of useful sealants include acrylic, urethane, butyl, silicone, or combinations thereof. By fixedly attaching collar portion 200 to the subject protrusion, a long¬ term watertight seal can be created between the protrusion and collar portion 200.

Flange portion 100 can be fixedly attached to a roofing surface using methods well known in the art, and by welding flange portion 100 to the roofing surface, a long-term watertight seal can be created between flange portion 100 and the roofing surface.

Although the invention has been shown and described with respect to certain embodiments, it is obvious that equivalent alterations and modifications will occur to others skilled in the art upon the reading and understanding of this specification. In particular with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A split-flashing composition for covering a protrusion from a roof, the composition comprising:

a single piece split flashing apparatus having;

a flange portion adapted for sealing to a roof surface, the flange portion being substantially planar and having an in-plane spiral shape that describes a closed-loop opening having a spiraling tear-drop shape for receiving the protrusion;

the flange portion having first and second flange end portions that are connected to each other in-plane and in an off-set manner;

a collar portion fixably attached to the flange portion;

a closed-loop collar-portion construction having a substantially curved wall section and a substantially planar wall section that are connected to each other and together define an internal volume of space, wherein the substantially curved wall section spirals outwardly from a first substantially curved wall section edge portion to a second substantially curved wall section edge portion;

the collar portion having a substantially conical shape, wherein the cross-sectional area of the internal volume of space decreases as the distance between the flange portion and the cross-sectional area increases, the cross-sectional area being in a plane that is substantially perpendicular to a collar-portion longitudinal axis;

the collar portion having a substantially planar wall section that is substantially perpendicular to both a first substantially curved wall section edge portion and a second substantially curved wall section edge portion, the substantially planar wall section extending radially from the collar portion longitudinal axis and radially beyond the curved wall section of the collar portion; and wherein the second curved wall section overlaps the first curved wall section.

2. The split-flashing composition of claim 1, wherein the flange portion in-plane spiral shape spirals outwardly in a clockwise or counterclockwise direction approximately 360 degrees.

3. The split-flashing composition of claim 1, wherein the substantially curved wall section spirals outwardly in a clockwise or counterclockwise direction approximately 360 degrees.

4. The split-flashing composition of claim 1, wherein the composition has a one-piece construction that does not include connective seams or welds.

5. The split-flashing composition of claim 1, wherein the substantially planar wall section is in a plane that is substantially perpendicular to both the flange portion and a segment of the substantially curved wall section.

6. The split-flashing composition of claim 1, further comprising a collar cap portion that is in a plane substantially parallel to the flange portion, wherein the collar cap portion at least partially covers the end of the collar portion that is opposite the flange portion.

7. The split-flashing composition of claim 1, further comprising at least one ring-like visual marking on the external surface of the substantially curved wall section, the ring-like marking positioned on the substantially curved wall section in such a way as to identify the working diameter of the collar portion at the at least one ring-like marking.

* * * * *